United States Patent [19]

Klemm

[11] Patent Number: 4,964,335

[45] Date of Patent: Oct. 23, 1990

[54] SCREEN PRINTING METHOD

[75] Inventor: Gerhard Klemm, Bielefeld, Fed. Rep. of Germany

[73] Assignee: Gerhard Klemm Maschinenfabrik GmbH & Co., Bielefeld, Fed. Rep. of Germany

[21] Appl. No.: 374,967

[22] Filed: Jun. 30, 1989

[30] Foreign Application Priority Data

Jul. 8, 1988 [DE] Fed. Rep. of Germany ..... 3823200

[51] Int. Cl.[5] ..... B41F 15/08

[52] U.S. Cl. ..... 101/129; 101/126

[58] Field of Search ..... 101/123, 124, 126, 129

[56] References Cited

U.S. PATENT DOCUMENTS

| | | | |
|---|---|---|---|
| 3,577,914 | 5/1971 | Ronge | 101/124 |
| 3,848,528 | 11/1974 | Seedorf | 101/126 X |
| 4,084,505 | 4/1978 | Ichinose | 101/124 X |
| 4,249,688 | 2/1981 | Klemm | 226/95 X |
| 4,747,715 | 5/1988 | Lahr | 226/95 X |

FOREIGN PATENT DOCUMENTS

| | | | |
|---|---|---|---|
| 1000006 | 8/1965 | United Kingdom | 101/123 |

*Primary Examiner*—Clifford D. Crowder

*Attorney, Agent, or Firm*—Peter K. Kontler

[57] ABSTRACT

A printing method which is practiced with a flat bed screen printing machine wherein the material to be printed is intermittently movable with or relative to an assembly including a flat bed at one side and a screen at the opposite side of the path for the material. The material moves with the assembly during application of paste and moves slowly relative to the assembly while the latter moves rearwardly to its starting position. The slow movement of the material serves to move its passer marks to optimum positions with reference to a detector. One or more squeegees are adjacent the screen. The screen can move relative to the squeegee(s), or the squeegee(s) can be mounted on the assembly for movement relative to the screen.

10 Claims, 2 Drawing Sheets

SCREEN PRINTING METHOD

BACKGROUND OF THE INVENTION

The invention relates to screen printing methods in general, and more particularly to improvements in screen printing methods which can be carried out with flat bed screen printing machines. Still more particularly, the invention relates to improvements in screen printing methods for the application of paste (such as printing ink) to flexible or rigid materials with a high degree of accuracy such as normally requires the application of so-called passer markers or marks and monitoring of the applied passer marks by detectors in order to ensure highly accurate positioning of selected portions of the material to be printed with reference to the stencil.

Commonly owned Klemm U.S. Pat. No. 4,510,864 discloses a screen printing machine wherein a flexible web to be printed is transported in two stages including a main stage for imprinting and a second stage for reading passer marks. An advantage of such machines is that the application of liquid material can be carried out with a high degree of accuracy. The reason is that the detector of passer marks ensures highly accurate positioning of a selected portion of the web preparatory to printing, and that the web portion which is to be printed lies absolutely flat. However, such high degree of accuracy is achieved at the expense of limiting the output of the machine. The web is advanced by an intermittently driven heated roller, which can be rotated at a reasonably high speed during the main stage but is rotated very slowly during the second stage which follows the main stage and consumes an inordinately large part of the total time which elapses for completion of a main stage and a second stage. Moreover, the web is idle in the course of the actual printing operation.

Published German patent application No. 31 36 175 discloses a screen printing machine with a counterpressure roller in lieu of a flat bed. The web is in motion during application of paste. The screen is located at a level above the counterpressure roller and is movable back and forth in and counter to the direction of forward movement of the web. The squeegees are stationary, i.e., the screen can move back and forth with reference to the squeegees. The position of the web (in order to move a passer mark to an optimum position) is corrected while the so-called flood bar or drag squeegee is in the process of flooding the pool of liquid medium and while the screen is in motion in the direction of forward movement of the web. This is possible because the screen is free to move relative to the counterpressure roller. The machine which is disclosed in this published German application operates intermittently in that it carries out a so-called two-stage operation, the same as the machine of Klemm U.S. Pat. No. 4,510,864. The counterpressure roller is mounted for rotation about a fixed axis, i.e., it cannot move in and/or counter to the direction of advancement of the web, the same as the flat bed of the machine in the patent to Klemm. Though the machine of the published German patent application is faster than the machine of Klemm, it cannot print with a degree of accuracy which can be achieved with a screen printing machine employing a flat bed.

OBJECTS OF THE INVENTION

An object of the invention is to provide a novel and improved screen printing method which exhibits (a) the advantages of printing methods which are carried out with flat bed screen printing machines and (b) the advantages of methods which are carried out with screen printing machines of the type wherein a flat bed is replaced with a counterpressure roller.

Another object of the invention is to provide a method which can be resorted to for the application of paste with a high degree of accuracy and at a high frequency.

A further object of the invention is to provide a method which renders it possible to shorten the working cycle of a screen printing machine without affecting the accuracy of application of paste to plates, sheets panels, webs or other materials to be printed.

An additional object of the invention is to provide a method which renders it possible to shorten and practically eliminate the intervals of idleness of the material to be printed.

SUMMARY OF THE INVENTION

A feature of the invention resides in the provision of a method of applying paste (e.g., printing ink) to a web in a screen printing machine wherein the web is intermittently advanced in a first direction along an elongated path which is flanked by a flat bed at one side and by a screen and at least one squeegee at the other side opposite the bed. The method comprises the steps of advancing the web in the first direction through a relatively short distance and simultaneously moving the bed and the screen jointly in a second direction counter to the first direction, and thereupon moving the bed and the screen jointly with the web in the first direction through a longer second distance and simultaneously applying paste to the web through the screen with the at least one squeegee.

In accordance with a first embodiment, the method further comprises the step of holding the at least one squeegee against movement in the first and second directions in the course of the advancing and moving steps.

The step of moving the bed and the screen jointly with the web in the first direction can include mechanically clamping the web between the bed and the screen by means of the at least one squeegee and/or pneumatically attracting the web to the bed.

If the screen is disposed between the path for the web and a plurality of squeegees, the method further comprises the steps of contacting the screen with one of the squeegees during movement of the screen in the second direction, and contacting and deforming the screen with another squeegee during movement of the screen in the first direction.

If the web has a series of passer marks, the advancing step includes advancing the web in the first direction at a first speed until one of the passer marks assumes a predetermined position. At least one of the moving steps then preferably includes moving the bed and the screen at a greater second speed.

In accordance with a second embodiment, the method further comprises the step of moving the at least one squeegee in the second direction jointly with the bed and the screen. Such method then preferably further comprises the step of transporting the at least one squeegee in the second direction with reference to the screen during joint movement of the bed and screen in the second direction, the step of moving the at least one squeegee in the first direction jointly with the bed and screen, and/or the step of transporting the at least one squeegee in the first direction with reference to the screen during joint movement of the bed and the screen in the first direction.

The novel features which are considered as characteristic of the invention are set forth in particular in the appended claims. The improved method itself, however, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
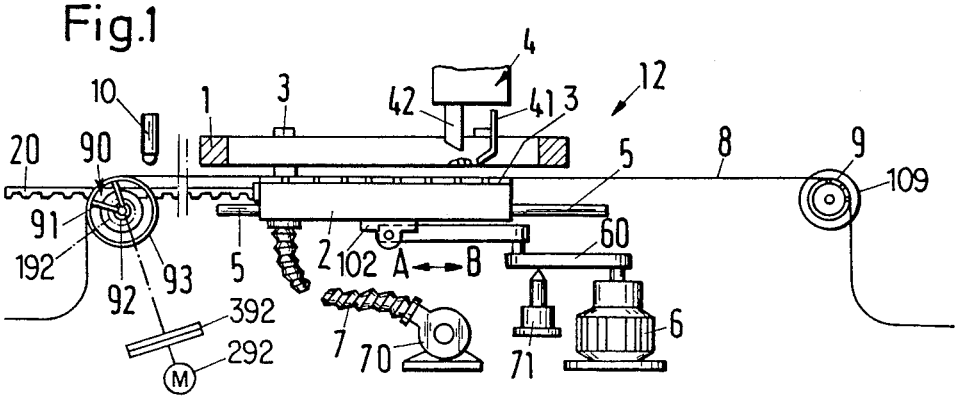
FIG. 1 is a fragmentary partly elevational and partly vertical sectional view of a screen printing machine which can be utilized for the practice of the improved method.

Referring first to FIG. 1, there is shown a portion of a first screen printing machine which can be used for the practice of the method according to the invention. The machine comprises means for advancing an elongated web 8 of paper, textile, plastic or other flexible material which is to be printed. The advancing means includes a suction pipe or tube 9 having two spaced apart flanges 109 flanking the marginal portion of the web which is trained over the tube 9. The exact manner in which the interior of the tube 9 is connected to a suction generating device so that the foraminous wall of the tube can attract the adjacent portion of the web 8 forms no part of the invention. The advancing means further comprises a suction wheel 90 which is installed in the machine frame downstream of the tube 9 and has a cylindrical web-contacting shell 93 which can be rotated in response to leftward movement of a toothed rack 20 which is mounted on and can be said to form part of a reciprocable assembly 12. The rack 20 mates with a gear 92 which is coaxial with the suction wheel 90 and can rotate the shell 93 in one direction through the medium of a freewheel 192.

The assembly 12 includes a flat bed or table 2 adjacent the underside of the path for the web 8 between the tube 9 and the suction wheel 90, and a flat screen 1 adjacent the upper side of such path opposite the bed 2. The parts 1 and 2 of the assembly 12 are coupled with each other in any one of a number of possible ways. FIG. 1 shows two suitably configurated brackets 3 which flank the path for the web 8 and are permanently but preferably separably affixed to the frame of the screen 1 as well as to the bed 2.

The assembly 12 can further comprise a carriage 102 which is affixed to the underside of the bed 2 and serves to move the entire assembly back and forth i.e., in and counter to a predetermined direction (arrows A and B) relative to the path for the web 8 between the tube 9 and the suction wheel 90. The means for moving the assembly 12 comprises a motor 6 and a crank arm 60 which is coupled with the carriage 102. The brackets 3 can be replaced with hooks and eyelets, tongs, clips or any other suitable mechanical coupling devices. Furthermore, it is possible to provide the assembly 12 with a driving connection between the screen 1 and the bed 2 (e.g., with a connection which pulls or pushes the screen 1 in response to movement of the bed 2 in the direction of arrow A or B, or vice versa. It is also possible to employ electromechanical, hydraulically operated or hydromechanical coupling means between the screen 1 and the bed 2.

The screen printing machine further comprises a stationary set 4 of squeegees 41 and 42 which are adjacent and are located above the screen 1. The squeegee 41 is a so-called drag squeegee (also called flood bar), and the squeegee 42 constitutes a pressure applying or printing squeegee for the liquid medium (called paste) which is to be applied to adjacent portion of the web 8 through the interstices of the stencil 11 (FIG. 2*a*) of the screen 1. The illustrated set 4 of two discrete squeegees 41 and 42 can be replaced with a single squeegee which serves to perform a flooding as well as a printing operation. In either event, the machine comprises means for moving the single squeegee or each of the two squeegees 41, 42 up and down to and from an operative position with reference to the screen 1. Nevertheless, the squeegee or squeegees are considered to be stationary because they do not share the movements of the assembly 12 in the directions which are indicated by arrows A and B. The mechanisms for moving the squeegees 41, 42 or a single squeegee between operative and inoperative positions are well known in the art of screen printing machines and need to be described here. Reference may be had to commonly owned U.S. Pat. Nos. 4,589,336 and 4,628,814.

Accurate guidance of the assembly 12 during movement in the direction of arrow A or B is ensured by one or more rails 5 or other suitable guide means. The rails 5 (only one shown in FIG. 1) flank the bed 1 and can define tracks for roller followers at the respective sides of the bed.

The screen printing machine further comprises means for pneumatically attracting the web 8 to the upper side of the bed 2 during certain stages of operation of the machine. Such attracting means includes a suction generating device 70 (e.g., a vacuum pump or a fan), a flexible hose 7 which connects the suction intake of the device 70 with a suction chamber in the bed 2 beneath a foraminous web-contacting top panel, and means 71 for intermittently operating the suction generating device 70. The arrangement is such that the web 8 is attracted to the upper side of the bed 2 when the printing squeegee 42 is in the process of forcing a liquid medium through the stencil 11 of the screen 1 and onto the upper side of the web above the bed. The operating means 71 is adjacent the path of orbital movement of the crank arm 60 and is operative to deactivate the suction generating device 70 or to disconnect this device from the chamber in the bed 2 when the web 8 is to be advanced relative to the assembly 12 and/or vice versa. The web 8 will be caused to advance relative to the assembly 12 when one of its passer marks (not shown in FIG. 1) must be advanced into the range of a detector 10 (FIGS. 2*a* to 2*e*) which arrests the advancing means for the web 8 when the oncoming passer mark reaches a predetermined optimum position in which a predetermined portion of the web 8 is located between the bed 2 and the screen 1. Such mode of operating the suction generating means 70 ensures that the bed 2 does not offer any, or any appreciable, resistance to movement of the web 8 relative to the assembly 12 when the advancing means is operated at a low speed (creeping speed) in order to move a passer mark to an optimum position with reference to the detector 10.

At least one of the flanges 109 is adjustable axially of the tube 9 to ensure proper guidance of wide or narrow webs.

The interior of the suction wheel 90 includes a sector-shaped suction chamber 91 which is held in a preselected angular position and is surrounded by the foraminous shell 93 of the wheel 90. The construction of this wheel can be similar to or identical with that of any one of the wheels which are disclosed, for example, in German Pat. No. 29 43 894 or in commonly owned U.S. Pat. No. 4,249,688. As explained above, the means for rotating the shell 93 in one direction includes the toothed rack 20 of the assembly 12, the gear 92 which is coaxial with the wheel 90, and the freewheel 192 between the gear 92 and the shell 90.

Alternatively but preferably in addition to the just described means for rotating the shell 93, the screen printing machine can comprise a discrete prime mover 292 and a slip clutch 392 (shown schematically as part of a torque transmitting connection between the output element of the prime mover 292 and the shell 93). The rack 20 forms part of the means for stepwise advancing the web through relatively long distances in order to move successive unit lengths of the web with the bed 2 and screen 1 in the direction of arrow A, and the prime mover 292 serves as a means for advancing the web 8 through short distances in order to place successive passer marks into exact register or otherwise into optimum positions with reference to the detector 10. The detector 10 then transmits a signal which arrests the prime mover 292.

The moving means including the motor 6 moves the assembly 12 and (through the medium of the toothed rack 20) the web 8 through substantial distances while the printing squeegee 42 is held in the operative position and forces the printing medium to pass through the interstices of the stencil 11 of the screen 1 into contact with the upper side of the web above the bed 2. At such time, the suction generating device 70 is operative to even more reliably ensure that the web 8 is pneumatically attracted to the upper side of the bed 2 and to thus guarantee that the web is compelled to share the movement of the assembly 12 in the direction of arrow A.

The web 8 is caused to move relative to the assembly 12 through a short distance (under the action of the prime mover 292) prior to movement of the assembly 12 in the direction of arrow A so that a passer mark assumes an optimum position with reference to the detector 10 when the forward movement of the assembly 12 (arrow A) is started while the printing squeegee 42 is held in the operative position.

The detector 10 is stationary and can be placed adjacent the upper side of the path for the web 8 immediately or closely upstream of the suction wheel 90.

The mode of operation of the improved screen printing machine will be described with reference to FIGS. 2*a* to 2*e*.

Figure 2A:
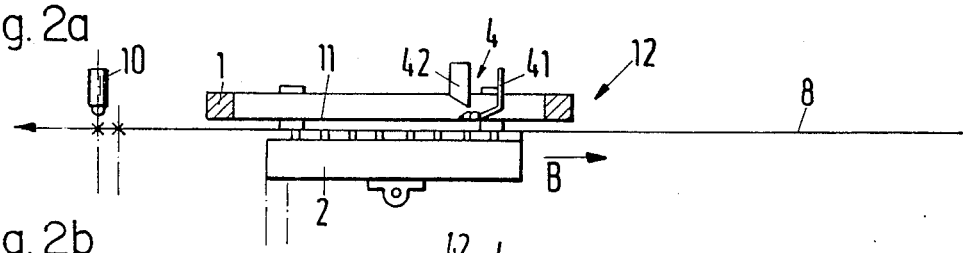
FIG. 2*a* illustrates a first stage of a cycle of the machine of FIG. 1.
Figure 2B:
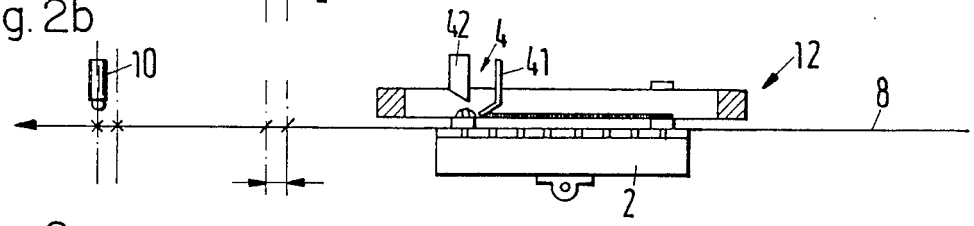
FIG. 2*b* illustrates a second stage of the cycle.

FIG. 2*a* shows the initial stage of dragging a pool of printing ink or other liquid medium (e.g., a chemical substance which is used to impregnate the web or a plastic substance which is used to form a layer on the respective side of the web). Such dragging is carried out by the squeegee 41 which is held in the operative position adjacent the foraminous stencil 11 of the screen 1. At such time, the screen 1 is lifted so that its stencil 11 is out of contact with the adjacent portion of the web 8. The moving means including the motor 6 moves the assembly 12 in the direction of arrow B, i.e., counter to the direction of advancement of the web 8 from the tube 9 toward the suction wheel 90. At the same time, the prime mover 292 is operative to advance the web 8 in the direction of arrow A (the web is attracted to the shell 93 of the wheel 90 by suction in the chamber 91) through a short or very short distance in order to move a passer mark into proper position with reference to the detector 10. The latter transmits a signal to arrest the prime mover 292 when the web 8 reaches an optimum position for the application of liquid medium to a predetermined length of its upper side. FIG. 2*b* shows the assembly 12 in its rear end position (upon completion of movement in the direction of arrow B) and the web 8 in proper position in which a passer mark is in an optimum position with reference to the detector 10 (i.e., the prime mover 292 is at a standstill).

Figure 2C:
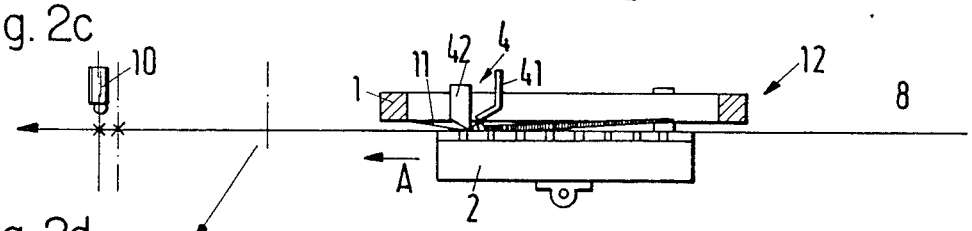
FIG. 2*c* illustrates a third stage of the cycle.

The next step involves a movement of the drag squeegee 41 to its inoperative position and a movement of printing squeegee 42 to its operative position. This is shown in FIG. 2*c*. If the machine comprises a single squeegee, the just mentioned step involves a change in the function of the single squeegee from that already performed by the drag squeegee 41 to that about to be performed by the printing squeegee 42. The stencil 11 of the screen 1 is pressed downwardly beneath the squeegee 42 and the lowermost portion of this squeegee is immediately adjacent the upper side of the bed 2 to define a so-called printing line. The motor 6 is then caused to move the assembly 12 relative to the squeegees 41, 42 in the direction of arrow A from the position of FIG. 2*c* to the position of FIG. 2*d*. The web 8 shares such movement of the assembly 12, and the stationary printing squeegee 42 forces liquid medium through the stencil 11 into contact with the upper side of the web portion between the front and rear ends of the screen 1. This completes the main or longer portion of forward movement of the web 8 during a complete cycle. The next step (shown in FIG. 2*e*) involves a lifting of the printing squeegee 42 to inoperative position and a movement of the drag squeegee 41 to operative position The prime mover 292 then advances the web 8 in order to move the next passer mark to an optimum position before the shell 93 of the wheel 90 is brought to a halt and the assembly 12 is ready to start its movement in the direction of arrow B, i.e., from the position of FIG. 2*e* (which corresponds to the position of FIG. 2*a*) to the position of FIG. 2*b*. The corrective step which is carried out while the shell 93 is rotated by the prime mover 292 takes place while the suction generating device 70 is arrested or is disconnected from the suction chamber of the bed 2 so that the web 8 is free to move with reference to the assembly 12.

The carriage 102 can be omitted if the crank arm 60 of the means for moving the assembly 12 is directly connected with the bed 2.

The freewheel 192 between the gear 92 and the toothed rack 20 ensures that the web 8 need not share the movements of the assembly 12 in the direction of arrow B. On the other hand, the rack 20 cooperates with the gear 92 and with the freewheel 192 to ensure that the web 8 moves in synchronism with the assembly 12 when the latter is caused to move in the direction of arrow A (from the position of FIG. 2*c* to the position of FIG. 2*d*). The suction generating device 70 also contributes to accurate synchronization of movements of the web 8 and assembly 12 in the direction of arrow A.

Figure 2D:
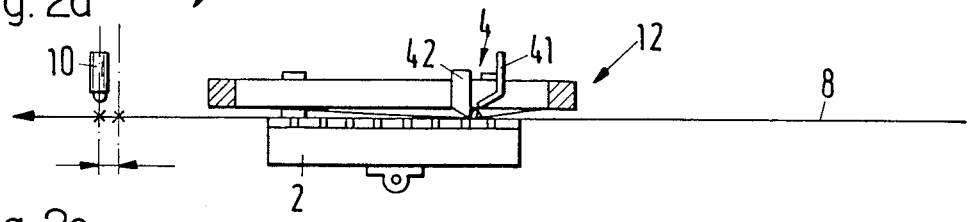
FIG. 2*d* illustrates a fourth stage of the cycle.
Figure 2E:
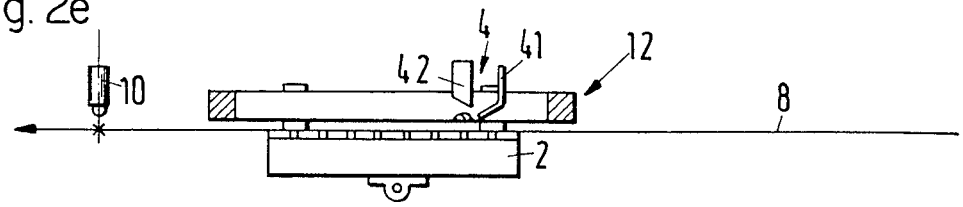
FIG. 2*e* illustrates a fifth stage of the cycle.

The suction wheel 90 constitutes an optional feature of the improved machine, at least as concerns its web advancing action in the direction of arrow A while the web moves with the assembly 12. The reason is that, as a rule, suction which is generated by the device 70 to attract the web 8 to the upper side of the bed 2 suffices to ensure that the web shares the movement of the assembly 12 from the position of FIG. 2*c* to the position of FIG. 2*d*. If the suction which is generated by the device 70 does not suffice to ensure predictable synchronization of movement of the web 8 with movement of the assembly 12 in the direction of arrow A, the assembly 12 can be provided with clamps or other means (not shown) for mechanically affixing the web to the bed 2 during movement of the assembly 12 in the direction of arrow A. The printing squeegee 42 (in the operative position which is shown in FIGS. 2*c* and 2*d*) also contributes to the establishment of a mechanical connection between the assembly 12 and the web 8 because it urges the adjacent portion of the stencil 11 against the web which, in turn, is urged against the upper side of the bed 2. The fact that the stencil 11 slides relative to the printing squeegee 42 when the assembly 12 moves from the position of FIG. 2*c* to the position of FIG. 2*d* does not affect the synchronizing action of the squeegee 42, i.e., a movement of the assembly 12 in the direction of arrow A merely involves a change in the locus of the printing line where the tip of the squeegee 42 urges the stencil 11 against the web 8 so that the latter is urged against the upper side of the bed 2.

Figure 3:
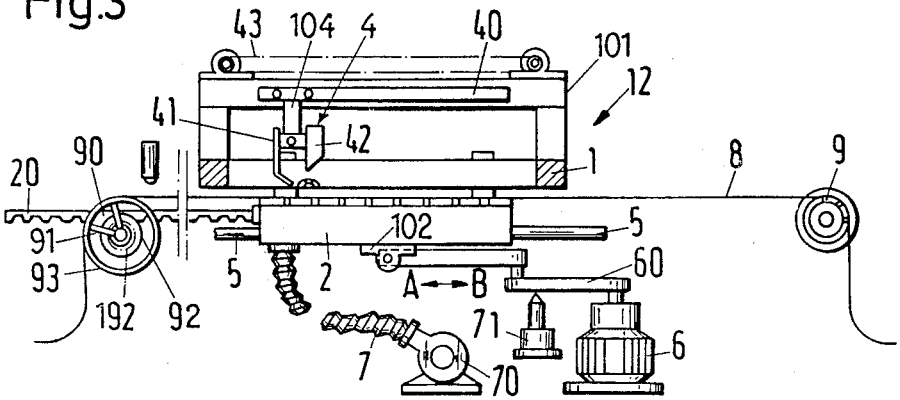
FIG. 3 is a fragmentary partly elevational and partly vertical sectional view of a modified screen printing machine.

FIG. 3 shows a portion of a modified screen printing machine wherein all such parts which are identical with or clearly analogous to the corresponding parts of the machine of FIG. 1 are denoted by similar reference characters. The main difference between the two machines is that the frame of the screen 1 which is shown in FIG. 3 carries a superstructure 101 for a transporting unit serving to transport the set 4 of squeegees 41 and 42 relative to the screen 1 and bed 2. The set 4 of squeegees 41, 42 and the transporting unit for the squeegees can be said to form part of the assembly 12 because all movements of the bed 2 and screen 1 are shared by the squeegees even though the squeegees are capable of moving relative to the bed and screen in directions which are indicated by the arrows A and B.

The set 4 of squeegees 41, 42 includes a trolley 104 which is reciprocably guided by one or more overhead rails 40 on the superstructure 101. The trolley 104 has a follower which is coupled to a motor-driven endless chain 43 or toothed belt trained over a pair of sprocket wheels or toothed pulleys on the superstructure 101.

Figure 4A:
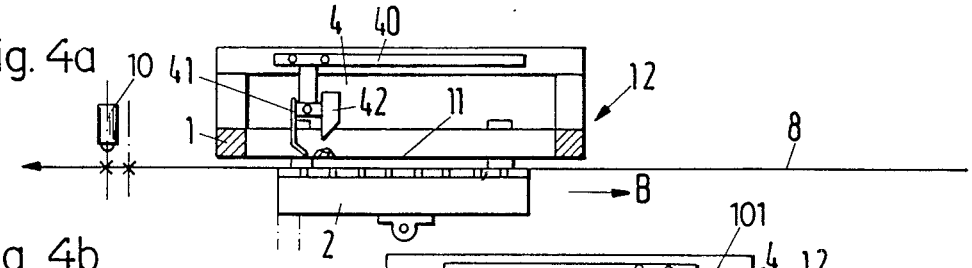
FIG. 4*a* illustrates a first stage of a cycle of the machine of FIG. 3.
Figure 4B:
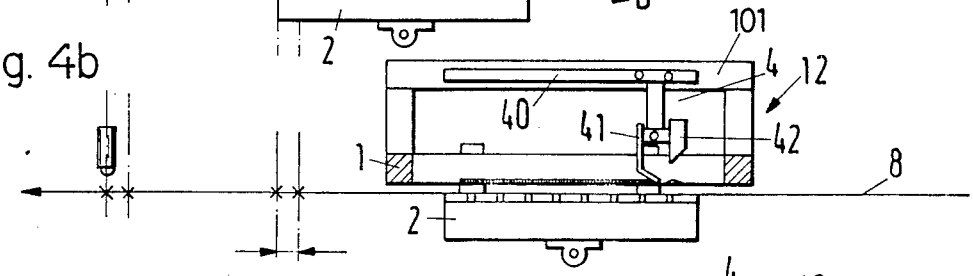
FIG. 4*b* illustrates a second stage of the cycle.

FIG. 4*a* shows the assembly 12 of the machine of FIG. 3 in a front end position just prior to start of movement in the direction of arrow B. The drag squeegee 41 is maintained in the operative position and the set 4 of squeegees 41, 42 is driven by the transporting unit including the chain or belt 43 so that it advances in the direction of arrow B relative to the bed 2 and screen 1. In other words, the absolute speed of the squeegee 41 relative to the web 8 is greater than that of the bed 2 and screen 1. The purpose of such transport of the set 4 in the direction of arrow B (relative to the bed 2 and screen 1) is to move the printing squeegee 42 to the starting position of FIG. 4*b* (in the rear part of the superstructure 101), preferably not later than when the assembly 12 completes its rearward movement under the action of the motor 6 and crank arm 60. The dragging or flooding of liquid medium on the stencil 11 of the screen 1 is completed when the assembly 12 reaches the position of FIG. 4*b*, and the drag squeegee 41 is then lifted and the printing squeegee 42 is lowered to assume its operative position. This can be seen in FIG. 4*c* which shows that the tip of the printing squeegee 42 urges the adjacent portion of the sieve 11 against the web 8 so that the latter is urged against the upper side of the bed 2.

Figure 4C:
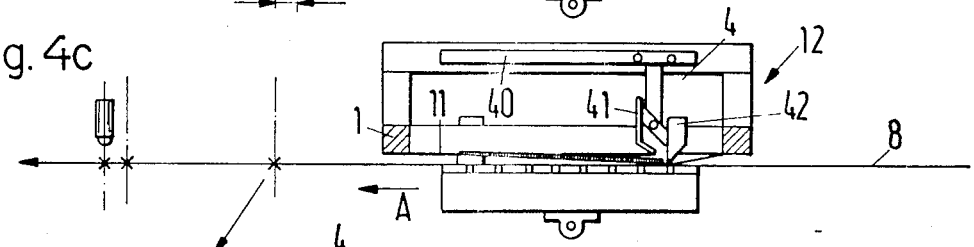
FIG. 4*c* illustrates a third stage of the cycle.
Figure 4D:
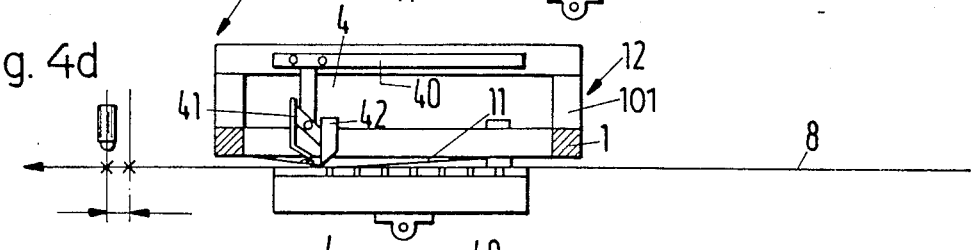
FIG. 4*d* illustrates a fourth stage of the cycle.
Figure 4E:
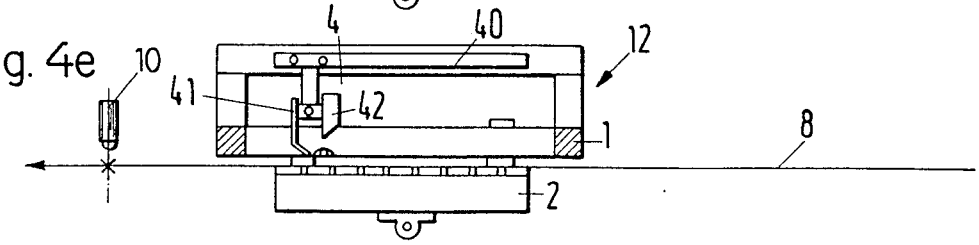
FIG. 4*e* illustrates a fifth stage of the cycle.

The next step involves a forward movement of the assembly 12 and web 8 in the direction of arrow A from the position of FIG. 4*c* to the position of FIG. 4*d*. At the same time, the chain or belt 43 drives the set 4 of squeegees 41, 42 relative to the bed 2 and screen 1 so that the set 4 advances from the rear part to the front part of the superstructure 101. In other words, the speed of the printing squeegee 42 relative to the web 8 (in the direction of arrow A) is not zero as in the machine of FIG. 1. The advancing printing squeegee 42 contributes to synchronization of forward movement of the web 8 with that of the bed 2 and screen 1, and such synchronization is further enhanced by the suction generating device 70 as well as by the toothed rack 20 which cooperates with a gear for the suction wheel 90 in the same way as described in connection with FIG. 1.

The last stage of a complete cycle involves deactivation of the suction generating device 70 and a movement of the web 8 relative to the assembly 12 in order to move a passer mark to an optimum position with reference to the detector 10. The shell 93 of the suction wheel 90 is then driven by the prime mover 292 (not shown in FIGS. 3 and 4*a*–4*e*) in the same way as in the machine of FIG. 1. At such time, the stencil 11 of the screen 1 is lifted above and away from the web 8 so that the drag squeegee 41 can be lowered and can start its movement toward the rear end of the superstructure 1 while the web 8 is advanced to move one of its passer marks to a predetermined position with reference to the detector 10. In other words, the set 4 of squeegees 41, is transported in the direction of arrow B with reference to the bed 2 and screen 1 while the web 8 advances in the direction of arrow A with reference to the bed 2 and screen 1. Thus, during this stage of a cycle, the speed of movement of the set 4 in the direction of arrow B exceeds the speed (zero) of the bed and screen 1 in such direction.

An advantage of the screen printing method with a machine having a mobile set of squeegees in the assembly 12 (FIG. 3) is that the output of the machine can be increased well above that of the machine of FIG. 1. The reason is that each stage or step of a cycle is shortened as a result of movability of the squeegees 41, 42 relative to the bed 2 and screen 1. This holds true for the stage when the drag squeegee 41 is operative to flood the liquid medium on the stencil 11 as well as during the actual printing stage when the drag squeegee 41 is raised but the printing squeegee 42 is held in the operative position.

The speed of transport of the set 4 relative to the bed 2 and screen 1 can greatly exceed the speed of movement of the entire assembly 12 in the direction of arrow A or B. This is due to the fact that the mass of the set 4 is a small fraction of the mass of the entire assembly 12.

The manner in which the web 8 is compelled to share the forward movement (arrow A) of the bed 2 and screen 1 is or can be the same as described in connection with FIGS. 1 and 2*a* to 2*e*, i.e., synchronization can be achieved by the suction generating device 70 alone or in conjunction with the printing squeegee 42 and/or in conjunction with the rack 20 and gear 92. If necessary, additional clamping means can be provided to even more reliably connect the web 8 to the screen 1 and bed 2 while the assembly 12 moves from the position of FIG. 4*c* to the position of FIG. 4*d*.

As a rule, those movements of the web 8 which are carried out in response to rotation of the shell 93 by the prime mover 292 are very slow (at a so-called creeping speed). The movement of the web 8 with the assembly 12 is carried out at a higher or much higher speed.

The described machine is preferably a relatively small compact machine which can be operated at a high speed. One presently preferred use of the machine is to imprint circuit boards, i.e., to apply printed matter to commodities which must be finished with an extremely high degree of precision. This is possible with the improved machine because the machine comprises means for ensuring that the web 8 invariably shares all movements of the assembly 12 in the direction of arrow A.

The coupling between the bed 2 and the screen 1 need not be a purely mechanical, electromechanical, hydraulically operated, pneumatically operated or other coupling. For example, it is also possible to synchronize the movements of the bed 2 and screen 1 with a computer so that these parts need not be bodily connected to each other but still constitute an assembly wherein the bed shares all movements of the screen and vice versa, at least in the directions which are indicated by arrows A and B. The same applies for the operative connection between the assembly 12 and the suction wheel 90, i.e., the latter need not be mechanically coupled with the assembly 12 (e.g., by a toothed rack, a gear and a freewheel) but can be driven by a separate prime mover in synchronism with movements of the bed 2 and screen 1 in the direction of arrow A. The exact details of such synchronizing means form no part of the present invention.

An important advantage of the improved screen printing method is that it embodies the advantages of printing with a flat bed printing machine and with a machine wherein the flat bed is replaced with a counterpressure roller. Thus, the machine can apply paste with a degree of accuracy which is achievable with a flat bed printing machine, and the machine can operate at a speed which is characteristic of a machine with a bed in the form of a roller. Higher output is achieved in that forward movement of the web 8 relative to the assembly 12 takes place at a time when the parts of the machine perform one or more other functions. In the machine of FIG. 1, the prime mover 292 drives the shell 93 to slowly advance a passer mark into an optimum position with reference to the detector 10 at a time when the assembly 12 moves in the direction of arrow B, i.e., the interval of time for moving the web 8 by way of the prime mover 292 is not added to the period of time which elapses while the machine performs other stages of a cycle but takes place simultaneously with such period of time. Analogously, the machine of FIG. 3 operates in such a way that the motor 292 advances the web 8, in order to properly position a passer mark with reference to the detector 10, simultaneously with a movement of the squeegees 41, 42 relative to the assembly 12 and while the assembly 12 moves from the position of FIG. 4*a* toward the position of FIG. 4*b*. The thus achieved savings in time are considerable since, in a conventional machine, the interval of time which elapses to slowly advance a passer mark into requisite position with reference to the detector can represent up to and even more than 30 percent of the period of time which is required to complete a cycle. The printing squeegee 42 is maintained in inoperative position and the drag squeegee 41 is maintained in operative position when the web 8 is advanced by the motor 292 for the purpose of properly positioning a passer mark because the squeegee 41 does not deform the stencil 11 into actual engagement with the web 8 between the screen 1 and bed 2. Therefore, the web is then free to move relative to the assembly 12 and/or vice versa. This ensures that the web 8 is in optimum position with reference to the detector 10 when the assembly 12 is ready to move in the direction of arrow A, namely when the web 8 is compelled to share the forward movement of the bed 2 and screen 1. Suction in the chamber 91 of the wheel 90 suffices to ensure that the shell 93 of this wheel prevents the web 8 from moving in the direction of arrow B (while the assembly 12 moves in the direction of arrow B), for example, due to slight frictional engagement between the web 8 and the bed 2 during this stage of a cycle.

In addition to being useful in connection with the application of paste to flexible webs (e.g., to webs of coherent labels or the like), the improved method can be practiced with equal or similar advantage for the application of printing ink or the like to relatively thick metallic or plastic webs, sheets or panels including webs, sheets or panels which cannot or should not be flexed at all. It is then necessary to replace the advancing means including the tube 9 and the suction wheel 90 with other suitable advancing means. However, the basic mode of operation of the machine remains unchanged. In either event (i.e., regardless of whether the material to be printed is flexible or rigid), that portion of the material which is disposed between the screen 1 and the bed 2 is absolutely flat to enhance the quality of the printing operation. It is well known that the quality of work which is performed by a flat bed screen printing machine is superior to that which is turned out by a screen printing machine wherein the bed is a counterpressure roller. Therefore, the improved method is ideally suited for the application of printing ink or other substances to base plates which are to be converted into printed circuit boards. The first step involves a treatment in the screen printing machine, and the thus treated plates are thereupon transferred into a stamping machine prior to being provided with electrical components. When the material to be printed includes rigid or substantially rigid plates, sheets or panels, such commodities can be supplied in the form of a file of successive plates or the like in a manner which is known from the art of treating relatively thick and rigid plastic sheets.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of repeatedly applying paste to a web in a screen printing machine wherein the web is intermittently advanced in a first direction along an elongated path which is flanked by a flat bed at one side and by a screen and at least one squeegee at the other side opposite the bed, comprising the steps of repeatedly advancing the web in said first direction through a relatively short first distance and simultaneously moving the bed and the screen jointly in a second direction counter to said first direction; and moving the bed and the screen subsequent to each advancing step jointly with the web in said first direction through a longer second distance and simultaneously applying paste to the web through the screen with the at least one squeegee.

2. The method of claim 1, further comprising the step of holding the at least one squeegee against movement in said first and second directions in the course of said advancing and moving steps.

3. The method of claim 1, wherein each step of moving the bed and the screen jointly with the web includes mechanically clamping the web between the bed and the screen by means of the at least one squeegee.

4. The method of claim 1, wherein each step of moving the bed and the screen jointly with the web includes pneumatically attracting the web to the bed.

5. The method of claim 1 of applying paste in a machine wherein the screen is disposed between the path and two squeegees, further comprising the steps of contacting the screen with one of the squeegees during movement of the screen in said second direction, and contacting and deforming the screen with the other of the squeegees during movement of the screen in said first direction.

6. The method of claim 1 of applying paste to a web having a series of passer marks, wherein each advancing step includes advancing the web at a first speed until one of the passer marks assumes a predetermined position, at least one of said moving steps including moving the bed and the screen at a greater second speed.

7. The method of claim 1, further comprising the step of moving the at least one squeegee in said second direction jointly with the bed and the screen.

8. The method of claim 7, further comprising the step of transporting the at least one squeegee in said second direction with reference to the screen during joint movement of the bed and screen in said second direction.

9. The method of claim 1, further comprising the step of moving the at least one squeegee in said first direction jointly with the bed and screen.

10. The method of claim 9, further comprising the step of transporting the at least one squeegee in said first direction with reference to the screen during joint movement of the bed and screen in said first direction.

* * * * *